US008779989B2

(12) United States Patent
Huang et al.

(10) Patent No.: US 8,779,989 B2
(45) Date of Patent: Jul. 15, 2014

(54) WIDEBAND ANTENNA

(75) Inventors: Kuo-Lun Huang, Hsinchu (TW); Yu-Yu Chiang, Hsinchu (TW); Shang-Ching Tseng, Hsinchu (TW)

(73) Assignee: Wistron NeWeb Corporation, Hsinchu Science Park, Hsinchu (TW)

( * ) Notice: Subject to any disclaimer, the term of this patent is extended or adjusted under 35 U.S.C. 154(b) by 170 days.

(21) Appl. No.: 13/462,783

(22) Filed: May 2, 2012

(65) Prior Publication Data

US 2013/0207861 A1 Aug. 15, 2013

(30) Foreign Application Priority Data

Feb. 10, 2012 (TW) ..... 101104315 A

(51) Int. Cl.
*H01Q 1/38* (2006.01)
*H01Q 1/48* (2006.01)

(52) U.S. Cl.
USPC ..... 343/700 MS; 343/848

(58) Field of Classification Search
CPC ..... H01Q 13/10; H01Q 9/42; H01Q 1/2266
See application file for complete search history.

(56) References Cited

U.S. PATENT DOCUMENTS

| | | | | |
|---|---|---|---|---|
| 7,450,070 | B2 * | 11/2008 | Chang et al. | 343/700 MS |
| 7,956,812 | B2 * | 6/2011 | Chen et al. | 343/700 MS |
| 8,059,035 | B2 * | 11/2011 | Chang et al. | 343/700 MS |
| 2007/0096987 | A1 * | 5/2007 | Bancroft et al. | 343/700 MS |
| 2010/0039329 | A1 * | 2/2010 | Chen et al. | 343/700 MS |
| 2011/0102272 | A1 * | 5/2011 | Wong et al. | 343/702 |
| 2011/0156958 | A1 * | 6/2011 | Wong et al. | 343/700 MS |
| 2012/0001815 | A1 * | 1/2012 | Wong et al. | 343/749 |
| 2012/0032856 | A1 * | 2/2012 | Huang et al. | 343/700 MS |
| 2012/0169568 | A1 * | 7/2012 | Oh et al. | 343/893 |
| 2013/0113661 | A1 * | 5/2013 | Chen et al. | 343/700 MS |

* cited by examiner

*Primary Examiner* — Trinh Dinh
(74) *Attorney, Agent, or Firm* — Winston Hsu; Scott Margo

(57) ABSTRACT

A wideband antenna includes a grounding unit electrically connected to a ground, a feed-in source for transmitting and receiving radio frequency signals, a first radiating body including a first radiating unit extending along a first direction, a second radiating unit extending along a second direction opposite to the first direction, and a conducting unit extending along a third direction, and a second radiating body including a short-circuit unit electrically connected to the grounding unit, a third radiating unit including a branch to generate a coupling connection effect with the conducting unit via a first distance, wherein an average perpendicular distance between the second radiating body and the grounding unit is smaller than an average perpendicular distance between the first radiating body and the grounding unit.

24 Claims, 9 Drawing Sheets

WIDEBAND ANTENNA

RELATED APPLICATIONS

This application claims priority under 35 U.S.C. 119 from TAIWAN 101104315 filed Feb. 10, 2012, the contents of which are incorporated herein by references.

BACKGROUND OF THE INVENTION

1. Field of the Invention

The present invention relates to a wideband antenna, and more particularly, to a wideband antenna which utilizes a vertical coupling connection effect.

2. Description of the Prior Art

An electronic product with a wireless communication function, e.g. a laptop, a personal digital assistant, etc., utilizes an antenna to emit or receive radio waves, to transmit or exchange radio signals, so as to access a wireless network. Therefore, to facilitate a user's access to the wireless communication network, an ideal antenna should maximize its bandwidth within a permitted range, while minimizing physical dimensions to accommodate the trend for smaller-sized electronic products.

In the prior art, e.g. publication number I318022 of Taiwan Intellectual Property Office (TIPO), a multi-band antenna 10 for wireless transmission is disclosed as shown in FIG. 1. The multi-band antenna 10 includes a ground portion 100, a first radiating portion 101, a fine tune portion 102, a second radiating portion 103, a third radiating portion 104, a feeder line 105 and a protruding point 106. By fine tuning a length L102 and a width W102 of the fine tune portion 102, the multi-band antenna 10 can obtain different impedance matching conditions, so as to correspondingly generate different radiating patterns and radiating energies to transmit radio signals in a transmitting band from 2.2 GHz to 2.6 GHz. However, with the advance of wireless communication technology, a wider operational band of the wireless communication system is anticipated, and the multi-band antenna 10 thus fails to satisfy different users' requirements. Therefore, it has become an important issue to provide an antenna which can effectively extend the transmitting band as well as minimize the physical dimension of the antenna.

SUMMARY OF THE INVENTION

It is therefore an objective of the invention to provide a wideband antenna which utilizes a vertical coupling connection effect.

The present invention discloses a wideband antenna comprising a grounding unit electrically connected to a ground; a feed-in source for transmitting and receiving radio frequency signals; a first radiating body comprising a first radiating unit extending along a first direction; a second radiating unit extending along a second direction opposite to the first direction; and a conducting unit extending along a third direction, and comprising one end electrically connected between the first radiating unit and the second radiating unit and another end electrically connected to the feed-in source; and a second radiating body comprising a short-circuit unit electrically connected to the grounding unit; a third radiating unit electrically connected to the short-circuit unit, and comprising a branch extending along the third direction to generate a coupling connection effect with the conducting unit via a first distance; wherein the first direction is approximately perpendicular to the third direction, and an average perpendicular distance between the second radiating body and the grounding unit is smaller than an average perpendicular distance between the first radiating body and the grounding unit.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
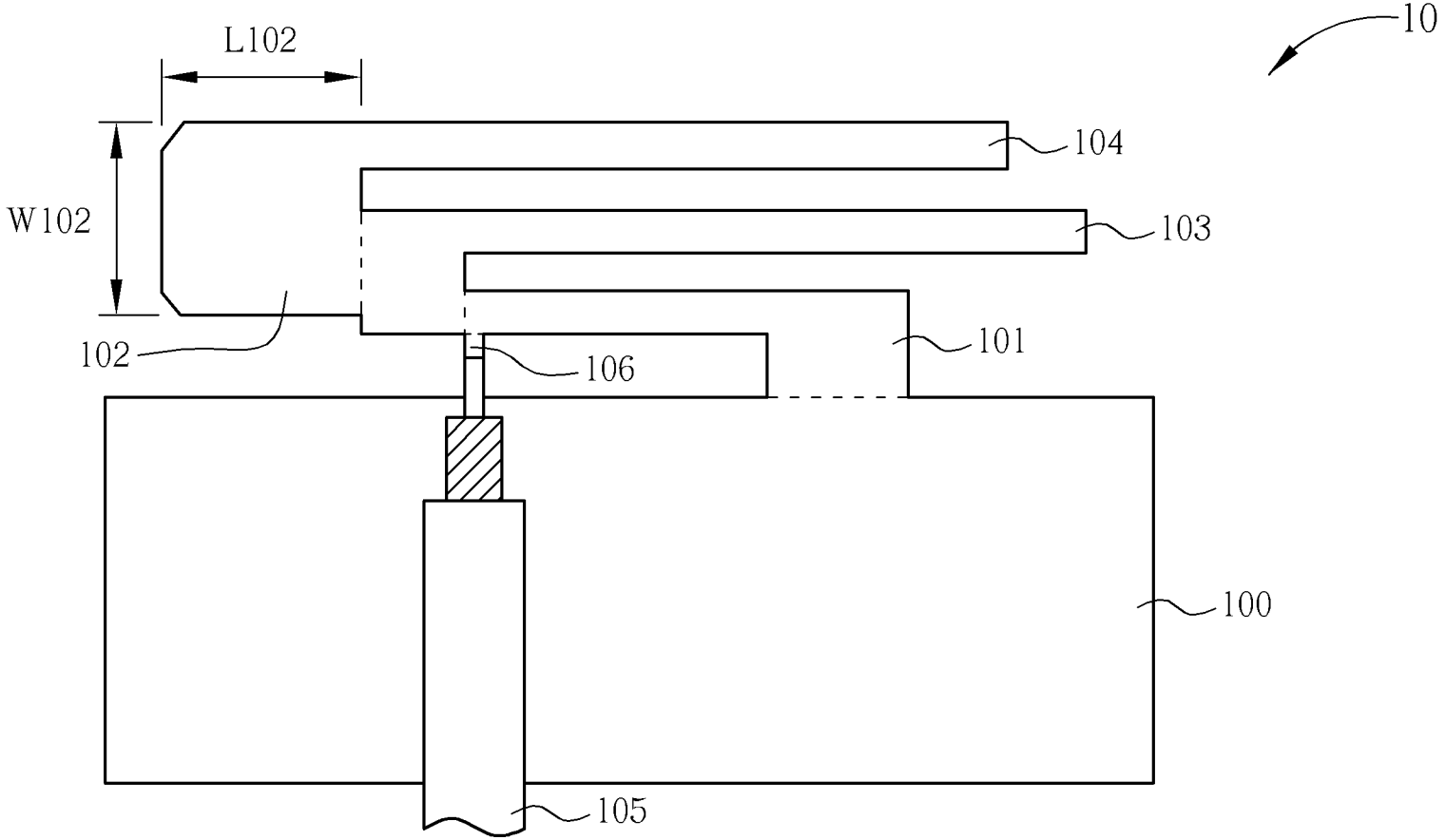
FIG. 1 PRIOR ART
FIG. 1 illustrates a conventional schematic diagram of a multi-band antenna.
Figure 2:
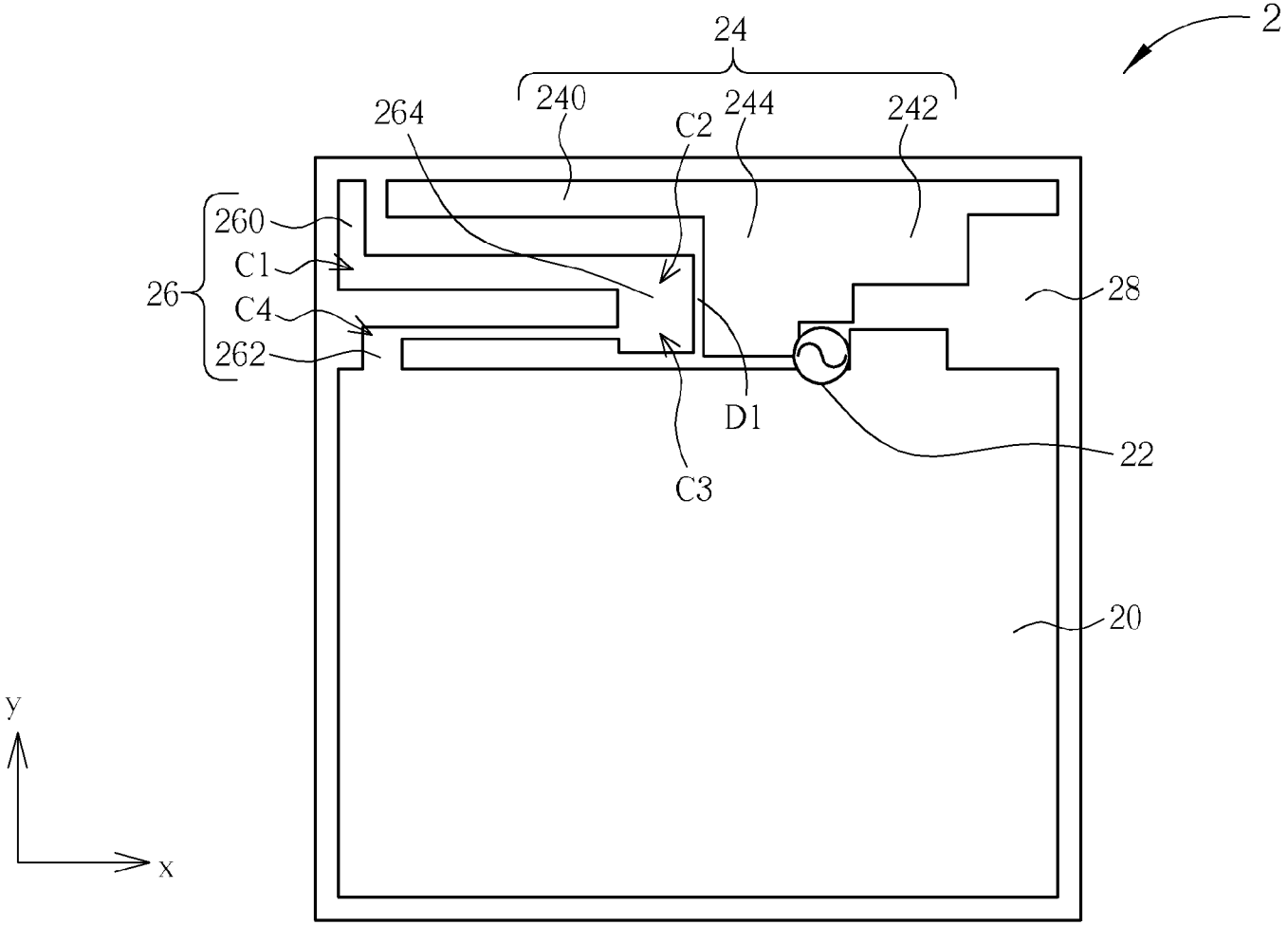
FIG. 2 illustrates a schematic diagram of a wideband antenna according to an embodiment of the invention

Please refer to FIG. 2, which illustrates a schematic diagram of a wideband antenna 2 according to an embodiment of the invention. As shown in FIG. 2, the wideband antenna 2 is located on an X-Y plane including an X-axis direction perpendicular to a Y-axis direction. The wideband antenna 2 loaded by a substrate 28 includes a grounding unit 20, a feed-in source 22, a first radiating body 24 and a second radiating body 26. The first radiating body 24 is utilized to transmit a high frequency band, and a total length of the first radiating body 24 is approximately equal to one fourth wavelength of the high frequency band. The first radiating body 24 further includes a first radiating unit 240, a second radiating unit 242 and a conducting unit 244. The first radiating unit 240 and the second radiating unit 242 both extend along the X-axis direction, and the conducting unit 244 horizontally connects the first radiating unit 240 and the second radiating unit 242, which means that the first radiating unit 240 and the second radiating unit 242 utilize the conducting unit 244 as a starting position to extend to opposite directions along the X-axis direction. Additionally, the conducting unit 244 electrically connects the first radiating unit 240 and the second radiating unit 242 with the feed-in source 22. Besides, the second radiating body 26 is utilized to transmit a low frequency band, and a total length of the second radiating body 26 is approximately equal to one fourth wavelength of the high frequency band. The second radiating body 26 further includes a third radiating unit 260 and a short-circuit unit 262. The short-circuit unit 262 electrically connects between the third radiating unit 260 and the grounding unit 20. The third radiating unit 260 further includes a branch 264 extending along the Y-axis direction, and the branch 264 is separated from the conducting unit 244 by a first distance D1, which provides a coupling connection effect for the third radiating unit 260 and the conducting unit 244, so as to transmit a radio signal between the third radiating unit 260 and the feed-in source 22. The grounding unit 20 electrically connects to a ground (not shown in the figure), and the feed-in source 22 is utilized to transmit wireless signals in the high frequency band and the low frequency band.

In detail, the wideband antenna 2 utilizes the first radiating body 24 and the second radiating body 26 to transmit the wireless signals in the high frequency band and the low frequency band, wherein the second radiating body 26 further includes a plurality of curves in the Y-axis direction, e.g. the curves C1, C2, C3, C4 in the embodiment of the invention, to form as a lighting shape, so as to provide the second radiating body 26 from the grounding unit 20 to the first radiating unit 240 of the first radiating body 24 extending along the Y-axis direction. Besides, an average perpendicular distance from a plurality of forming elements/branches of the second radiating body 26 to the grounding unit 20 is smaller than an average perpendicular distance from a plurality of forming elements/branches of the first radiating unit 240 to the grounding unit 20, i.e. the first radiating unit 240 is approximately located spatially above the second radiating unit 26. In order to maintain the coupling connection effect between the third radiating unit 260 and the conducting unit 244, the branch 264 is separated from the conducting unit 244 by a distance less than 5 mm. In the embodiment, one end of the second radiating unit 242 of the first radiating body 24, which is the end closest to the feed-in source 22, forms a staircase-shape with one or more steps, so as to conveniently provide the feed-in source 22 to feed in the radio signal, which is not limited hereinafter.

Figure 3:
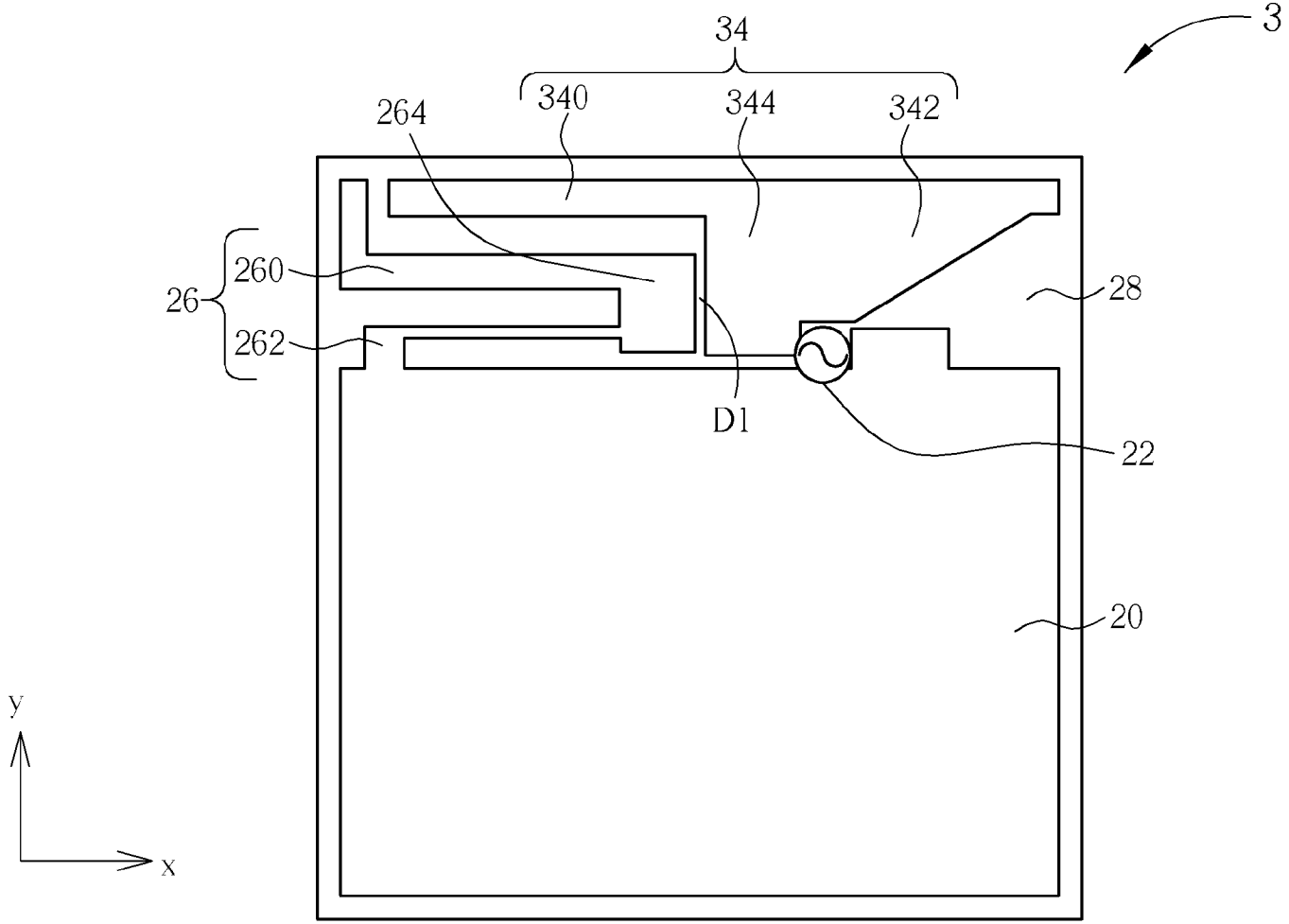
FIG. 3 illustrates a schematic diagram of another wideband antenna according to an embodiment of the invention.

Please refer to FIG. 3, which illustrates a schematic diagram of another wideband antenna 3 according to an embodiment of the invention. As shown in FIG. 3, the wideband antenna 3 has the similar forming elements of the wideband antenna 2. In comparison with the one end of the first radiating body 24 shown in FIG. 2, one end of the first radiating body 34 of the wideband antenna 3 forms a slope-shape, which means the staircase-shape of the second radiating unit 242 is replaced to be a smooth line. According to different users' requirements, the invention can modify/adjust the shape of the second radiating unit 242 (342), e.g. to combine the slope-shape as well as the staircase-shape within one embodiment, which is also the scope of the invention.

Figure 4:
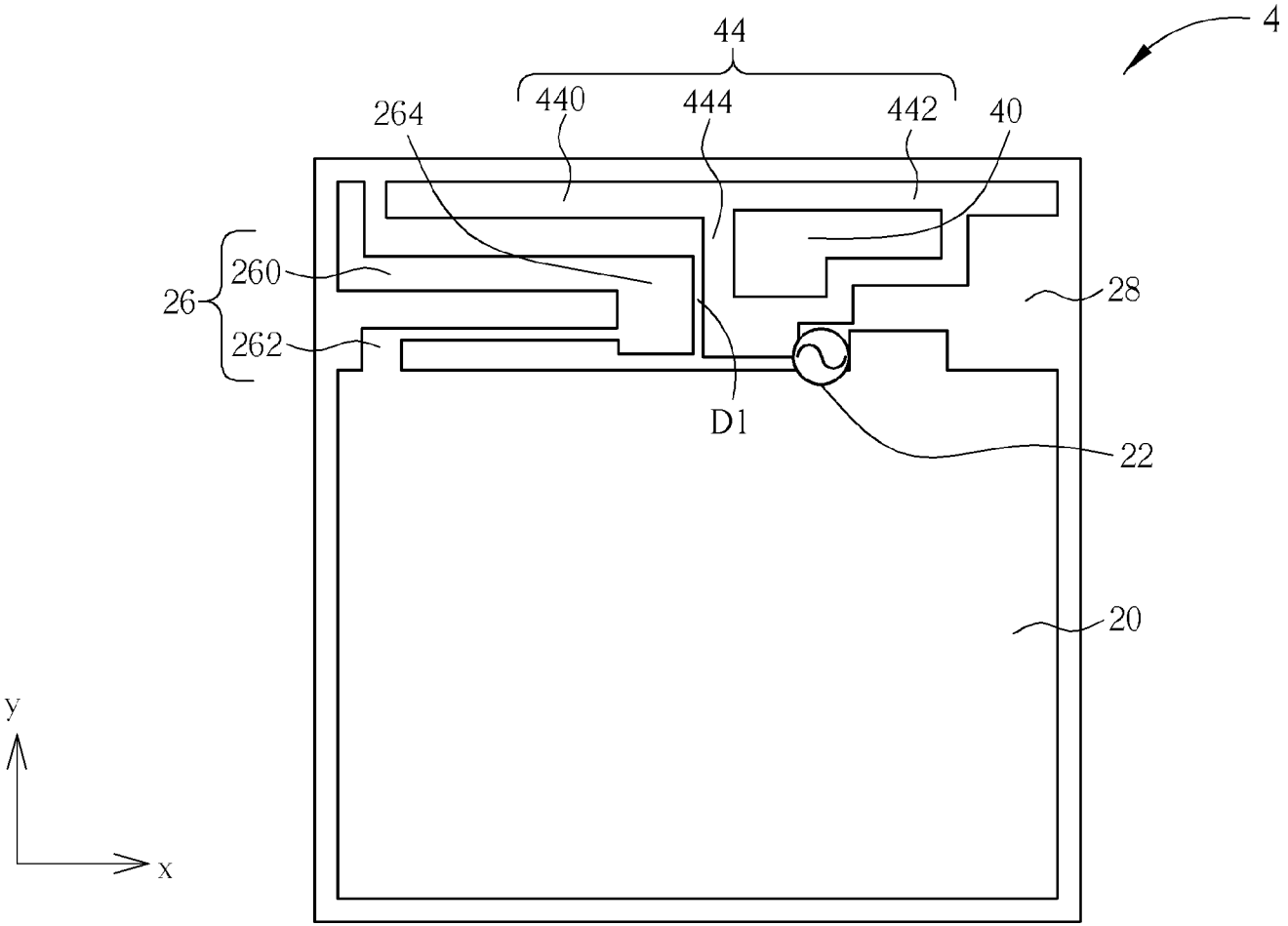
FIG. 4 illustrates a schematic diagram of another wideband antenna according to an embodiment of the invention.

Please refer to FIG. 4, which illustrates a schematic diagram of another wideband antenna 4 according to an embodiment of the invention. As shown in FIG. 4, the wideband antenna 4 has the similar forming elements of the wideband antenna 2. In comparison with the wideband antenna shown in FIG. 2, the first radiating body 44 of the wideband antenna 4 further includes a slot 40, and the slot 40 is located within an overlapping area of the first radiating unit 440, the second radiating unit 442 and the conducting unit 444. In this embodiment, the slot 40 is demonstrated as a rectangular shape. According to different users' requirements, the invention can modify/adjust the shape of the slot 40, so as to maintain the efficiency and the convenience of the feed-in source 22 to feed in the radio signals as well as to provide a more flexible connecting design of the first radiating unit 440, the second radiating unit 442 and the conducting unit 444, which is not limited hereinafter.

Figure 5:
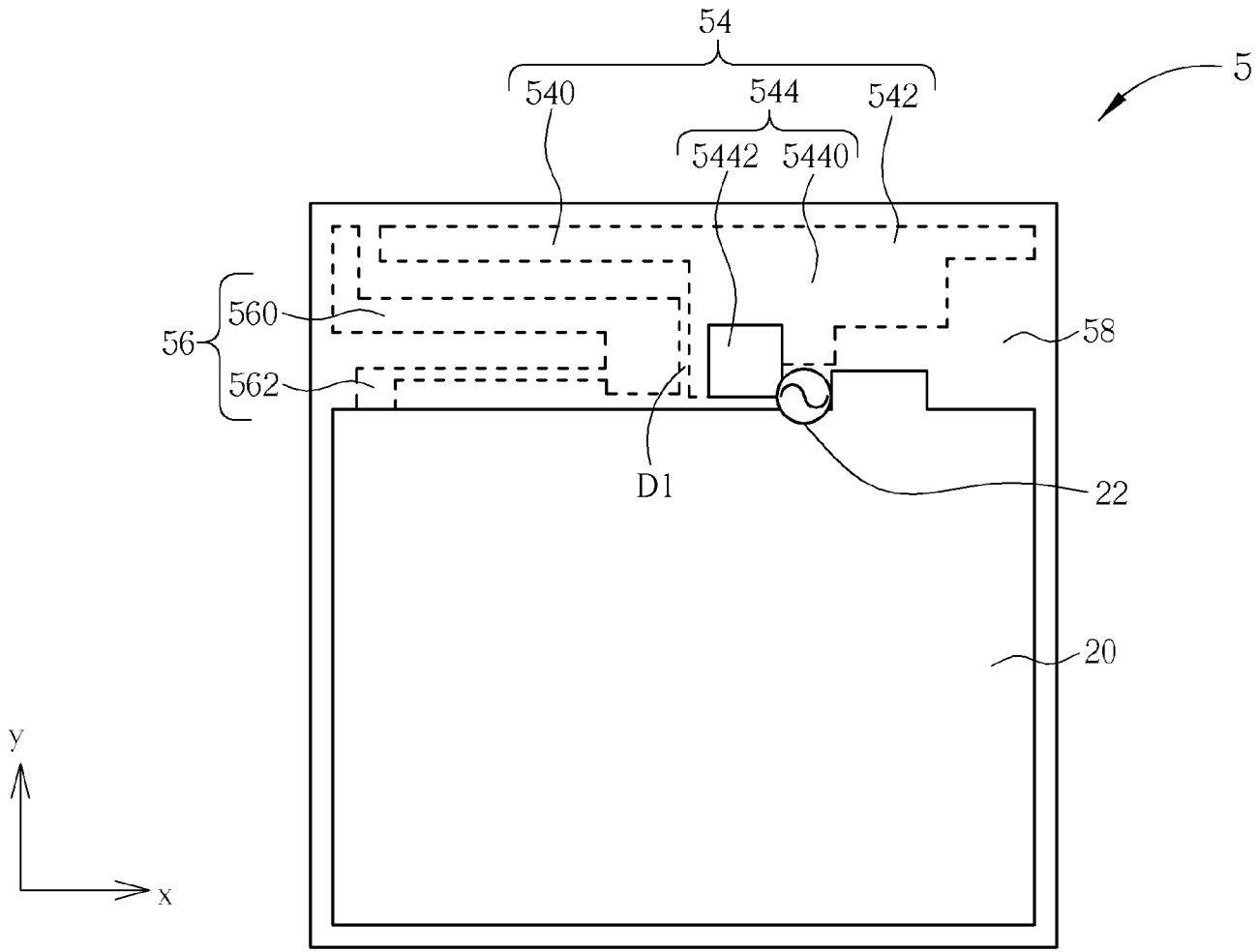
FIG. 5 illustrates a schematic diagram of another wideband antenna according to an embodiment of the invention.

Please refer to FIG. 5, which illustrate a schematic diagram of another wideband antenna 5 according to an embodiment of the invention. As shown in FIG. 5, the wideband antenna 5 has the similar forming elements of the wideband antenna 2, but the wideband antenna 5 further includes a conducting part 5440 and a coupling part 5442 of the conducting unit 544 of the first radiating body 54 . Additionally, the wideband antenna 5 is located on the X-Y plane loaded by a substrate 58 or etched onto the substrate 58. In this embodiment, the substrate 58 further includes two planes, and for the convenience, elements loaded on the first plane are depicted with solid lines and elements loaded on the second plane are depicted with dotted lines. In detail, the first plane loads the grounding unit 20, the feed-in source 22 and the coupling part 5442, and the second plane loads the first radiating unit 540, the second radiating unit 542, and the conducting part 5440 of the first radiating body 54, the third radiating unit 560 and the short-circuit unit 562 of the second radiating body 56. Since a projection result of the coupling part 5442 is formed onto the second plane of the substrate 58 to partially overlap the conducting part 5440, the conducting part 5440 and the coupling part 5442 are also electrically connected via the coupling connection effect. Under such circumstances, the feed-in source 22 can directly couple to the coupling part 5442, and the coupling part 5442 can transmit the radio signals to the conducting part 5440 via the coupling connection effect, so as to transmit the radio signals via the first radiating body 54 and the second radiating body 56. The conducting part 5440 shares similar operational principles with the conducting unit 244, and other forming elements of the first radiating body 54 and the second radiating body 56 can be understood via the FIG. 2 and the related paragraphs of the wideband antenna 2, which is not described hereinafter.

Figure 6:
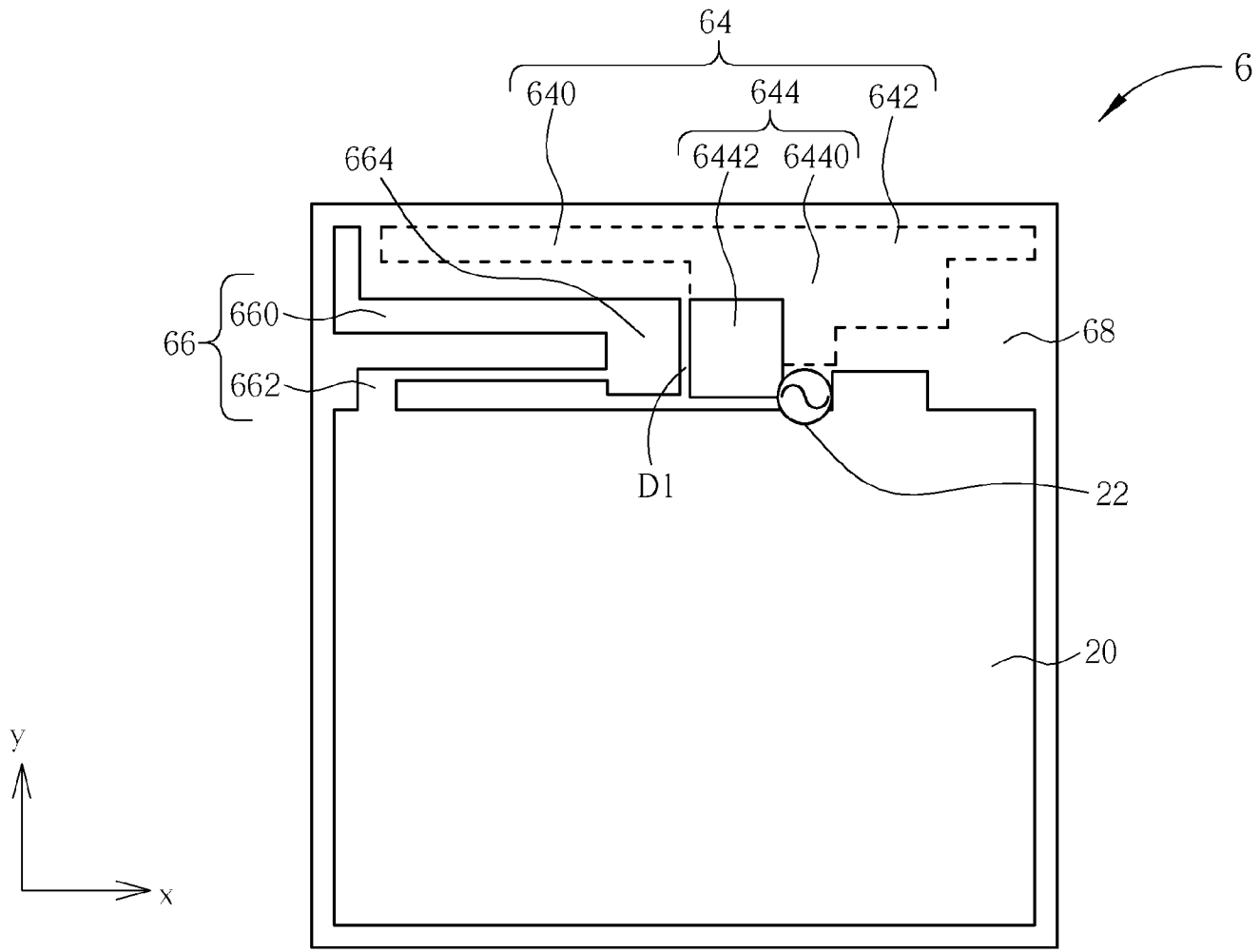
FIG. 6 illustrates a schematic diagram of another wideband antenna according to an embodiment of the invention.

Please refer to FIG. 6, which illustrates a schematic diagram of another wideband antenna 6 according to an embodiment of the invention. As shown in FIG. 6, the wideband antenna 6 is similar to the wideband antenna 5, and utilizes the solid lines as well as the dotted lines to demonstrate different loaded elements onto the first plane and the second plane, respectively. The difference is that the first plane of the substrate 68 of the wideband antenna 6 loads the grounding unit 20, the feed-in source 22, the coupling part 6442 and the second radiating body 66, and the second plane loads the first radiating body 64. According to the embodiment, the conducting part 6440 and the coupling part 6442 also share an overlapping projection result to form the coupling connection effect, so as to electrically connect the first radiating body 64 with the feed-in source 22. The second radiating body 66 utilizes a branch 664 to form the coupling connection effect with the coupling part 6442, which is similar to the operation of the branch 264 and the conducting unit 244 shown in FIG. 2. Besides, the branch 664 is also separated from the coupling part 6442 by the first distance D1 less than 5 mm, so as to transmit the radio signals between the second radiating body 66 and the feed-in source 22. Other forming elements of the first radiating body 64 and the second radiating body 66 can be understood via the FIG. 2 and the related paragraphs of the wideband antenna 2, which is not described hereinafter.

According to the various embodiments, the wideband antenna 2 of the invention utilizes the first radiating body 24 and the second radiating body 26 to form the vertical coupling connection effect, so as to transmit the radio signals in the high frequency band as well as the low frequency band. Certainly, the wideband antenna 2 can arbitrarily combine the embodiments shown in FIG. 3 to FIG. 6 with additionally different forming element designs, so as to further provide users a wider application field.

Figure 7:
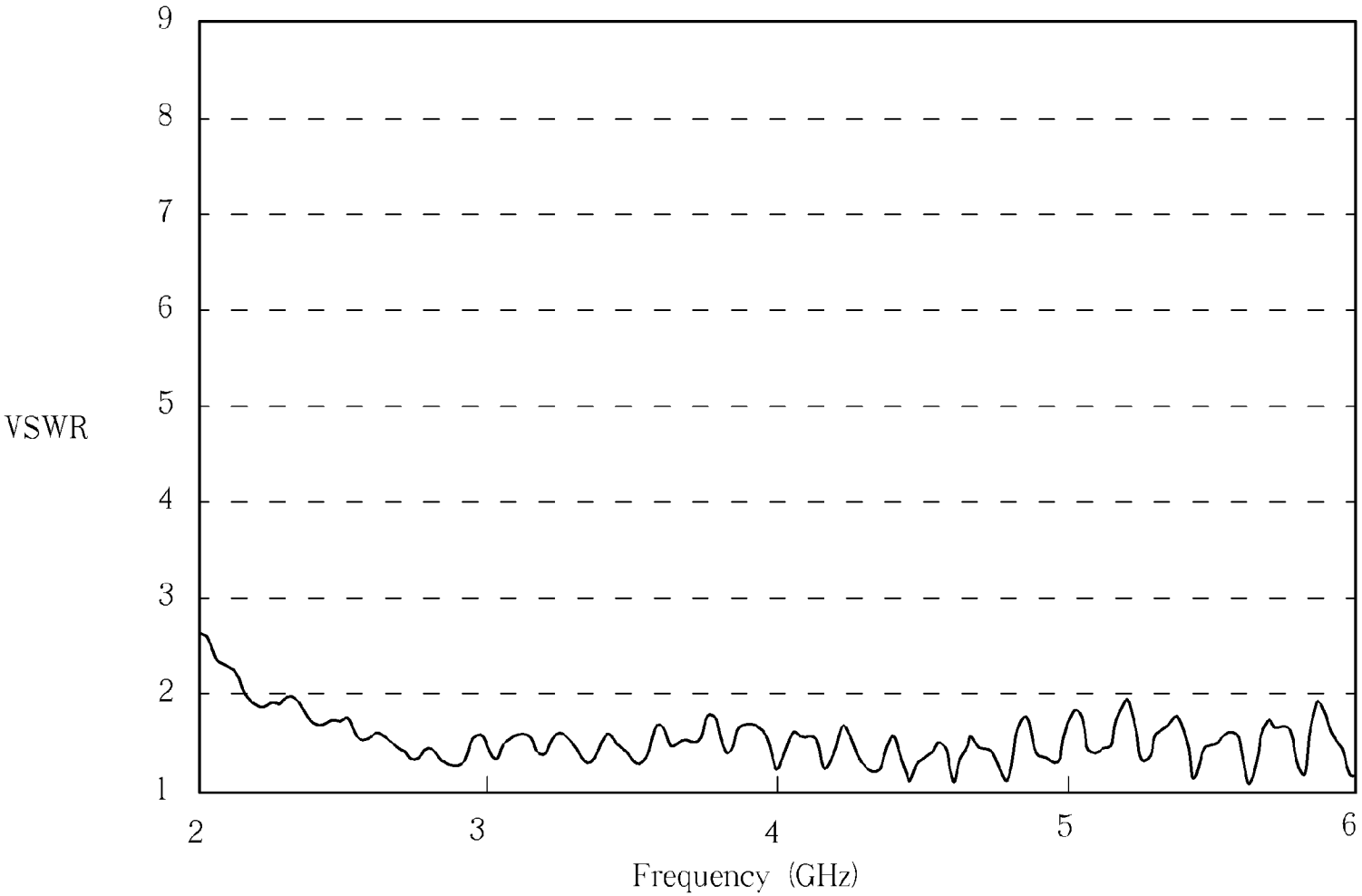
FIG. 7 illustrates a schematic diagram of the voltage standing wave ratio measured from the wideband antenna shown in FIG. 2.

Please refer to FIG. 7, which illustrates a schematic diagram of the voltage standing wave ratio (VSWR) measured from the wideband antenna 2. As shown in FIG. 7, the wideband antenna 2 provides not only the wider application field, but also a broadband wireless transmitting range, e.g. from 2.2 GHz to 6 GHz, which has satisfied an ideal transmitting condition with the VSWR smaller than 2, and more particularly with the VSWR smaller than 1.5 in particular transmitting frequency band.

Figure 8:
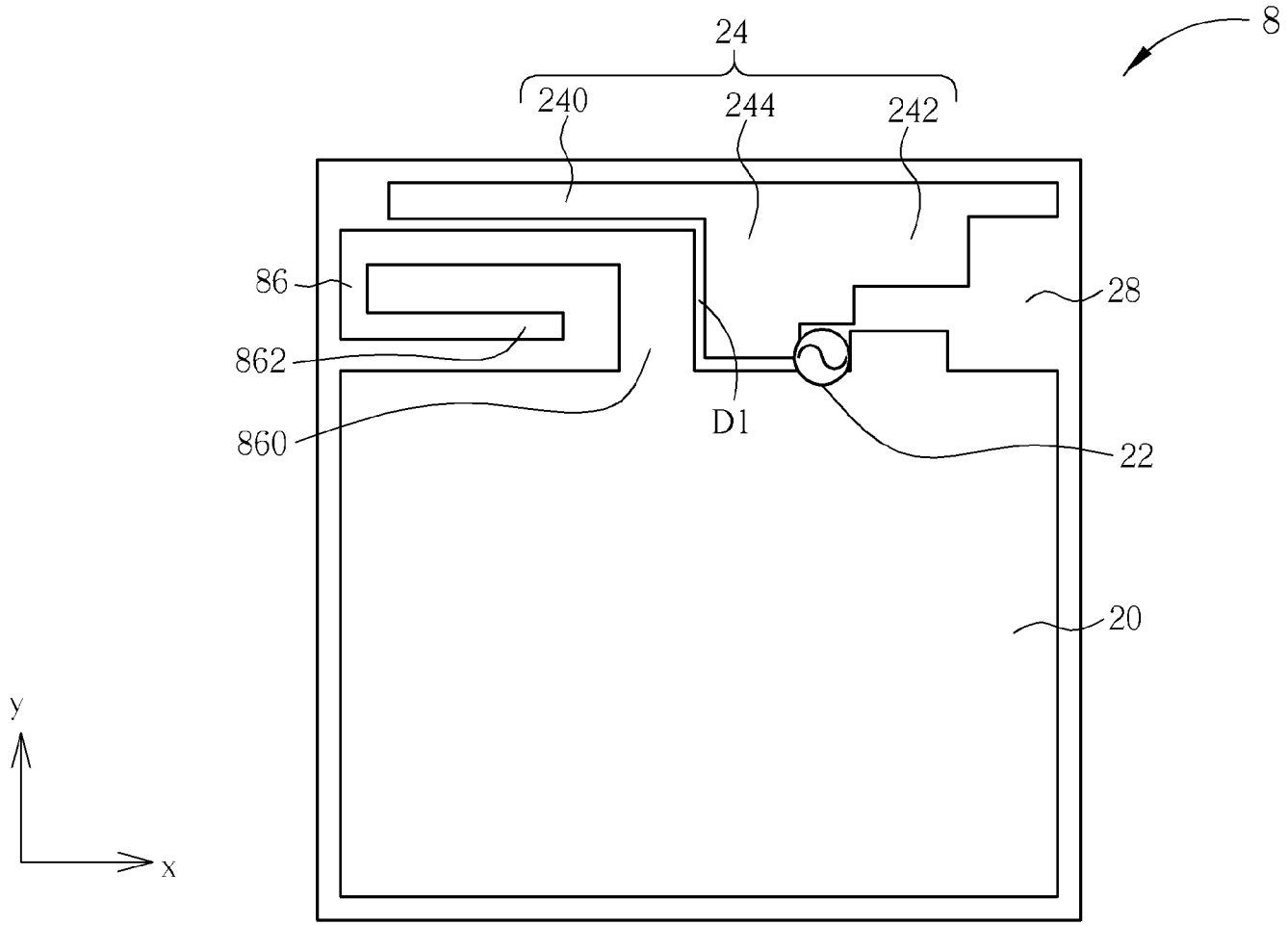
FIG. 8 illustrates a schematic diagram of another wideband antenna according to an embodiment of the invention.
Figure 9:
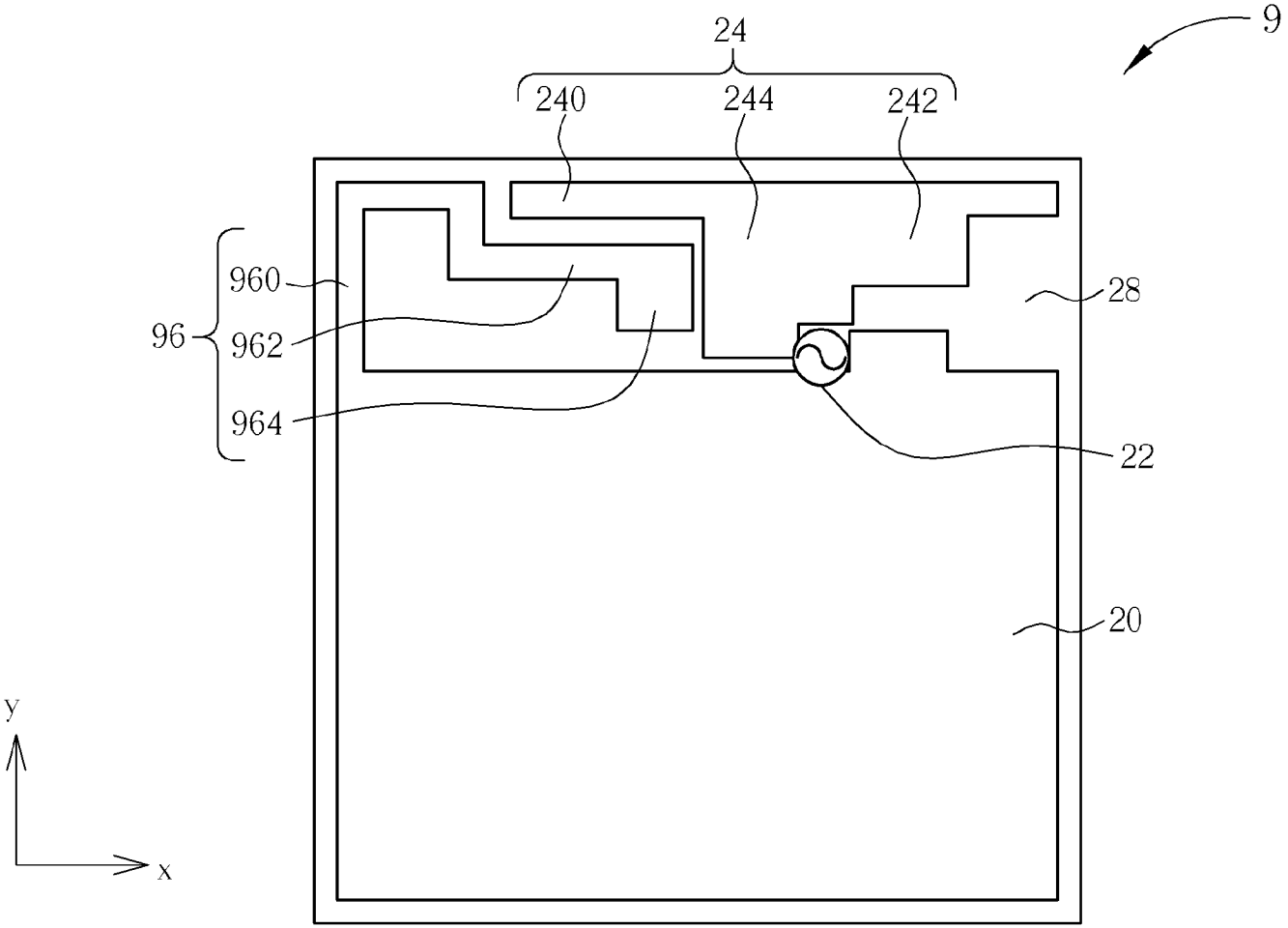
FIG. 9 illustrates a schematic diagram of another wideband antenna according to an embodiment of the invention.

Furthermore, more embodiments can be provided according to the conception of the wideband antenna 2 which provides the vertical coupling connection effect for the first radiating body 24 and the second radiating body 26. Please refer to FIG. 8 and FIG. 9, wherein FIG. 8 illustrates a schematic diagram of another wideband antenna 8 according to an embodiment of the invention, and FIG. 9 illustrates a schematic diagram of another wideband antenna 9 according to an embodiment of the invention. As shown in FIG. 8, the wideband antenna 8 is similar to the wideband antenna 2, but has different shaped designs of the second radiating body 86. The second radiating body 86 still remains the total length equal to the one fourth wavelength of the low frequency band, and one terminal part 862 of the second radiating body 86 is located away from the first radiating unit 240 and close to the grounding unit 20. The second radiating body 86 also includes a plurality of curves to electrically connect to the grounding unit 20 via a branch 860 similar to the short-circuit unit. The branch 860 also regarded as a partial unit of the third radiating unit is closely adjacent to the conducting unit 244, so as to form the coupling connection effect of the branch 860 and the conducting unit 244 and to transmit the radio signals between the second radiating body 86 and the feed-in source 22.

As shown in FIG. 9, the wideband antenna 9 also provides another design of the second radiating body 96, which utilizes a branch 960 as the short-circuit unit to electrically connect to the grounding unit 20. Also, one terminal part 964 of the second radiating body 96 is located away from the first radiating unit 240 and close to the grounding unit 20. The second radiating body 96 still remains a total length equal to the one fourth wavelength of the low frequency band. In comparison with the second radiating unit 86 of the wideband antenna 8, a connecting part of the second radiating body 96 and the grounding unit 20 (i.e. the branch 960) is not adjacent to the conducting unit 244. The second radiating body 96 can utilize another branch 962 regarded as a partial unit of the third radiating unit to form the coupling connection effect with the conducting unit 244, so as to transmit the radio signals between the second radiating body 96 and the feed-in source 22. Noticeably, the above embodiments are only examples, and those skilled in the art can adjustably modify/change connecting ways or elements of the second radiating body and the grounding unit, so as to transmit the radio signals between the second radiating body and the conducting unit, which is also the scope of the invention.

Besides, the grounding unit 20, the feed-in source 22 and the substrate 28 are familiar to those skilled in the art, which is not described hereinafter. In practical application, according to different users' requirements or systems, those skilled in the art can further adjust sizes, materials or locations of different elements of the wideband antenna 2, so as to extend the application field of the wideband antenna 2. Additionally, the different embodiments of the invention are easily demonstrated by locating these elements to be parallel or perpendicular to each other to spare more space for design concerns, which can also be done in conjunction with adjustably installing/reducing curves of the forming elements, so as to achieve the same purpose, and such modifications are within the scope of the invention.

In summary, the invention provides a wideband antenna which includes a first radiating body approximately located above a second radiating body, and a conducting unit of the first radiating body is disposed to form a vertical coupling connection effect with the second radiating body via a distance. According to different users' requirements, structural changes/modifications of these forming elements of the first radiating body and the second radiating body can be modified. Alternatively, two planes of a substrate loading the wideband antenna can be utilized to separately load the forming elements of the first radiating body and the second radiating body, so as to provide users a more flexible application field. In comparison with the prior art, the wideband antenna of the invention is more suitable for transmitting radio signals in the high frequency band as well as in the low frequency band, and has better VSWR in wireless transmitting process.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A wideband antenna comprising:

a grounding unit electrically connected to a ground;

a feed-in source for transmitting and receiving radio frequency signals;

a first radiating body comprising:

a first radiating unit extending along a first direction;

a second radiating unit extending along a second direction opposite to the first direction; and a conducting unit extending along a third direction, and comprising one end electrically connected between the first radiating unit and the second radiating unit and another end electrically connected to the feed-in source; and a second radiating body comprising:

a short-circuit unit electrically connected to the grounding unit;

a third radiating unit electrically connected to the short-circuit unit, and comprising a branch extending along the third direction to generate a coupling connection effect with the conducting unit via a first distance;

wherein the first direction is approximately perpendicular to the third direction, and a distance between a side of the second radiating body facing the grounding unit and the grounding unit is smaller than a distance between a side of the first radiating unit facing the grounding unit and the grounding unit, such that a combination of the first radiating body and the grounding unit externally surrounds the second radiating body.

2. The wideband antenna of claim 1, wherein the second radiating unit is demonstrated as a staircase-shape or a slope-shape.

3. The wideband antenna of claim 1, wherein the first distance is less than 5 micrometers.

4. The wideband antenna of claim 1, wherein the second radiating unit comprises a slot.

5. The wideband antenna of claim 1, wherein the third radiating unit comprises at least one curve.

6. The wideband antenna of claim 1, wherein the short-circuit unit comprises at least one curve.

7. The wideband antenna of claim 1, further comprising a substrate for loading the first radiating body, the second radiating body and the grounding unit.

8. The wideband antenna of claim 7, wherein the conducting unit comprises:

a conducting part located on a first plane of the substrate and electrically connected to the first radiating unit and the second radiating unit, and a coupling part located on a second plane of the substrate and electrically connected to the feed-in source, and a projection result of the conducting part projected onto the second plane partially overlaps with the coupling part to generate a coupling connection effect with the conducting part.

9. The wideband antenna of claim 8, wherein the first plane of the substrate loads the first radiating body and the second radiating body, the second plane of the substrate loads the grounding unit, and the conducting part is separated from the branch of the third radiating unit via the first distance.

10. The wideband antenna of claim 8, wherein the first plane of the substrate loads the first radiating body, the second plane of the substrate loads the grounding unit and the second radiating body, and the coupling part is separated from the branch of the third radiating unit via the first distance.

11. The wideband antenna of claim 1, wherein the branch of the second radiating body is integrated with the short-circuit unit to electrically connect with the grounding unit.

12. The wideband antenna of claim 1, wherein a terminal part of the third radiating unit is substantially adjacent to the first radiating unit.

13. The wideband antenna of claim 1, wherein a terminal part of the third radiating unit is not adjacent to the first radiating unit.

14. A wideband antenna comprising:

a grounding unit electrically connected to a ground;

a feed-in source for transmitting and receiving radio frequency signals;

a first radiating body comprising:

a first radiating unit extending along a first direction;

a second radiating unit extending along a second direction opposite to the first direction; and a conducting unit extending along a third direction, and comprising one end electrically connected between the first radiating unit and the second radiating unit and another end electrically connected to the feed-in source; and a second radiating body comprising:

a short-circuit unit electrically connected to the grounding unit;

a third radiating unit electrically connected to the short-circuit unit, and comprising a branch extending along the third direction to generate a coupling connection effect with the conducting unit via a first distance; and a substrate for loading the first radiating body, the second radiating body and the grounding unit;

wherein the first direction is approximately perpendicular to the third direction, and a distance between a side of the second radiating body facing the grounding unit and the grounding unit is smaller than a distance between a side of the first radiating unit facing the grounding unit and the grounding unit;

wherein the conducting unit further comprises:

a conducting port located on a first plane of the substrate and electrically connected to the first radiating unit and the second radiating unit; and a coupling part located on a second plane of the substrate and electrically connected to the feed-in source, and a projection result of the conducting part projected onto the second plane partially overlaps with the coupling part to generate a coupling connection effect with the conducting part.

15. The wideband antenna of claim 14, wherein the second radiating unit is demonstrated as a staircase-shape or a slope-shape.

16. The wideband antenna of claim 14, wherein the first distance is less than 5 micrometers.

17. The wideband antenna of claim 14, wherein the second radiating unit comprises a slot.

18. The wideband antenna of claim 14, wherein the third radiating unit comprises at least one curve.

19. The wideband antenna of claim 14, wherein the short-circuit unit comprises at least one curve.

20. The wideband antenna of claim 14, wherein the first plane of the substrate loads the first radiating body and the second radiating body, the second plane of the substrate loads the grounding unit, and the conducting part is separated from the branch of the third radiating unit via the first distance.

21. The wideband antenna of claim 14, wherein the first plane of the substrate loads the first radiating body, the second plane of the substrate loads the grounding unit and the second radiating body, and the coupling part is separated from the branch of the third radiating unit via the first distance.

22. The wideband antenna of claim 14, wherein the branch of the second radiating body is integrated with the short-circuit unit to electrically connect with the grounding unit.

23. The wideband antenna of claim 14, wherein a terminal part of the third radiating unit is substantially adjacent to the first radiating unit.

24. The wideband antenna of claim 14, wherein a terminal part of the third radiating unit is not adjacent to the first radiating unit.

* * * * *